US006150938A

United States Patent [19]

Sower et al.

[11] Patent Number: 6,150,938

[45] Date of Patent: Nov. 21, 2000

[54] LASER LIGHTING ASSEMBLY MOUNTED ON A FORKLIFT TO PROJECT A LIGHT BEAM PARALLEL TO AND IN THE SAME PLANE AS A FORK AND UTILIZED TO ACCURATELY DIRECT THE FORK INTO A FORK RECEIVING VOLUME OF A PALLET, THEREBY AVOIDING ANY FORK DAMAGE TO A LOAD ON A PALLET

[76] Inventors: Forrest D. Sower, 11923 Maple Pl., Anderson Island, Wash. 98303; Matthew Scott Sower, 1222 Heron Ave., Hayden, Id. 83835

[21] Appl. No.: 09/151,479

[22] Filed: Sep. 9, 1998

[51] Int. Cl.[7] ..... G08B 13/18

[52] U.S. Cl. ..... 340/557; 340/555; 340/686.2; 250/491.1

[58] Field of Search ..... 360/557, 555, 360/556, 903, 340, 686.2, 686.6; 180/167; 250/491.1

[56] References Cited

U.S. PATENT DOCUMENTS

| | | | |
|---|---|---|---|
| 3,119,501 | 1/1964 | Lemelson | 214/16.4 |
| 4,552,376 | 11/1985 | Cofer | 280/477 |
| 4,678,329 | 7/1987 | Lukowski et al. | 356/152 |
| 4,683,373 | 7/1987 | Tuman | 340/556 |
| 4,684,247 | 8/1987 | Hammill, III | 356/152 |
| 5,219,258 | 6/1993 | Yeakley | 414/275 |
| 5,285,205 | 2/1994 | White | 340/932.2 |
| 5,446,535 | 8/1995 | Williams | 356/153 |
| 5,684,287 | 11/1997 | Walts | 235/462 |
| 5,710,553 | 1/1998 | Soares | 340/903 |

*Primary Examiner*—Jeffery A. Hofsass
*Assistant Examiner*—Anh La
*Attorney, Agent, or Firm*—Roy E. Mattern, Jr.

[57] ABSTRACT

A laser lighting assembly, or another type of a directed high intensity collimated beam of light assembly, mountable on a forklift, or like purpose lifting and carrying equipment, to project at least one light beam, which is always directed parallel to and in the same plane as a fork or pair of forks, which are movably mounted on the lifting and carrying equipment for being raised and lowered. The projected light beam, during operations of the forklift, reflects from a changeable spot location on a load to be lifted, which is supported on a pallet, or is supported on a like fork receiving structure. When the fork is being either raised or lowered to be inserted, for example, in a fork receiving volume of a pallet, an operator of the forklift is observing the changeable spot location. When the changeable spot location is no longer reflecting from the load, and, in effect disappears, as the light beam projects into a fork receiving volume below the load, then the operator knows he or she has the fork, or pair of forks, or a like projecting support, positioned at the same elevation of the fork receiving volume. Thereafter, when the lifting and carrying equipment is moved forward, the fork accurately moves into the fork receiving volume, and no portion of a fork touches any portion of the load supported on a pallet, or on another like fork receiving load supporting structure, whereby the supported load is kept free of any possible damage to be otherwise possibly caused by a contracting fork.

15 Claims, 4 Drawing Sheets

LASER LIGHTING ASSEMBLY MOUNTED ON A FORKLIFT TO PROJECT A LIGHT BEAM PARALLEL TO AND IN THE SAME PLANE AS A FORK AND UTILIZED TO ACCURATELY DIRECT THE FORK INTO A FORK RECEIVING VOLUME OF A PALLET, THEREBY AVOIDING ANY FORK DAMAGE TO A LOAD ON A PALLET

BACKGROUND

Forklifts are extensively used in the handling of materials to be moved and to be stored both inside structures and outside, in various column volume locations, preferably utilizing pallets which are designed to have fork receiving volumes. Considerable skill is necessary for a forklift operator to quickly adjust the elevation of the forks to the proper vertical location before removing the forklift toward the load on the pallet to insert the forks into the fork receiving volumes.

Unfortunately operators of forklifts quite often begin inserting the forks when they are positioned either too high or too low. When the forks are not positioned at the correct vertical height, the tips of the forks can come into contact with the load to be lifted, thus damaging portions of the load.

The vertical height adjustment of the forks is usually accomplished by an operator of a forklift by his or her manual control of levers located in the control locale, while the operator is seated on the forklift. The operator generally undertakes the elevation adjustment or determination of the level of the forks, when the tips of the forks are in the range of six to twenty four inches in front of the load on a pallet to be moved. Once the operator judges that the forks are at the right height or elevation, then the operator, in reference to his skill level and/or judgment, drives the forklift forwardly in the range of slowly to quickly.

At this time or stage of the forklift moving forward, the forks, or fork, will sometimes miss entering the fork receiving volume and damage to a load may occur. At least, the forklift must be reversed by the operator and he or she will move the forks either up or down, and then drive the forklift forward again hoping that the second try will be successful. This second try and perhaps a third try, depending on the skill of the operator, is time consuming, often very frustrating to an operator, and unfortunately quite costly in respect to the damages sustained by portions of the load, i.e. products, materials and their packaging.

Operators with less experience often tend to be more careful and to move the forklift more slowly to avoid damaging portions of a load, yet on occasions they do cause damage. Operators with more experience, while tending to be careful, move their forklifts more quickly, yet on occasions they do cause damage.

Presently there is no known equipment, assembly, and/or accessory available for installation on a forklift to assist an operator in accurately determining the correct elevation of forks, or a fork, for entry into the fork receiving volume of a pallet, or a receiving volume of another type of load supporting and handling structure.

In respect to inventions set forth in U.S. patents with respect to alignments, directions, elevations, etc.:

In U.S. Pat. No. 4,678,329 of Jul. 7, 1987, Messrs. Lukowski and Hammill illustrate and describe their automatically guided vehicle control system, having a target member on a pallet, and a high intensity light source with an imaging sensor carried on a forklift truck. Their vehicle control system is used to guide a forklift to a pallet locale;

In U.S. Pat. No. 4,684,247 of Aug. 4, 1987, Harry B. Hammill III disclosed his target member for use in a positioning system. This target member is also disclosed in U.S. Pat. No. 4,678,329, and both these patents indicate a control system used in guiding a forklift to a pallet locale;

In U.S. Pat. No. 3,119,501 of Jan. 28, 1964, Jerome H. Lemelson illustrates and describes his automatic warehousing system. Along an overhead track, an assembly of a vertical track is moved horizontally. At selected locations a fork subassembly is moved up and down on its vertical track assembly to lift loads into and out of various spaced storage volumes, each having fork receiving volumes. The respective horizontal and vertical positions of the vertical track assembly and its fork subassembly are determined by utilizing photoelectric scanners carried by them, which scan the positions of indicating reflective markers respectively located on the overhead track and on the vertical members of the racking system;

In U.S. Pat. No. 5,219,258 of Jun. 15, 1993, Lester M. Yeakley discloses his illumination apparatus for a robotic object handling system. His system uses two angularly directed light sources, carried by a movable gripper mechanism, to eventually light up an entry to a selected storage tray among many like trays positioned in an overall close spaced arrangement to receive, for example, magnetic tape cartridges. When the selected storage tray is in position to receive the movable gripper mechanism, a shadow is cast immediately below the entry of the tray;

In U.S. Pat. No. 5,446,535 or Aug. 29, 1995, John H. Williams illustrates and describes his firearm non-firing sight alignment system. A laser light assembly is mounted in a housing, which in turn, by use of a mandrel, is exactly concentrically aligned with a firearm's muzzle. The collimated beam of light from the laser light assembly is directed to a target. Then as may be necessary, the sights of the firearm are aligned with the same target.

In U.S. Pat. No. 5,285,205 of Feb. 8, 1994, Bernard H. White discloses his laser guided vehicle positioning system. In parking areas or volumes, laser lighting equipment is placed to direct a guiding beam of light along a selected direction. A vehicle equipped with an observable target area at a predetermined location on its windshield is guided into the parking area by the driver maneuvering the vehicle, so the guiding beam of light is always being reflected and observed in the target area.

In U.S. Pat. No. 4,552,376 of Nov. 12, 1985, Archie Cofer illustrates and describes his trailer hitch lamp guide. A lamp mounted on the tongue of a trailer directs a beam of light upwardly and forwardly at an angle. When a towing vehicle equipped with a translucent target member is backed up, as the hitching position is approached, the directed beam of light is observed on the translucent target member. When the center of the beam of light is centered on a preselected portion of the translucent target member, the driver of the towing vehicle then knows the respective trailer hitch components are in a pre-cooperative coupling position.

These U.S. patents collectively disclose the utilization of light beams, which via their reflections at designated locations, help observers to make adjustments in positioning components, and/or help robotic equipment to make adjustments in positioning components.

SUMMARY

To assist an operator of a forklift or like purpose lifting and carrying equipment, during his or her maneuvering of such equipment, so the operator will not damage any portion of a load being handled when supported on a pallet, or like purpose load supporting structure, by having a projecting support, such as a fork or a pair of forks, hit a portion of a load resulting in damage to the load, a directed high intensity collimated beam of light assembly, or a laser lighting assembly, is mounted on the forklift or like purpose lifting and carrying equipment.

Hereinafter: the lifting and carrying equipment will be referred to as a forklift; the projecting supports as forks; the directed high intensity collimated beam of light assembly as a laser lighting assembly; and the load supporting structure as a pallet.

With the laser lighting assembly being activated, the laser light beam is directed forward parallel to the forks and in the same plane of the forks at whatever vertical height location they are then located. The laser light beam commences alongside a fork and remains parallel to the fork throughout its projected length.

When a forklift is being maneuvered to approach a vertical storage volume, which is being filled, or emptied, in respect to stackable pallet loads, the projected laser light beam shows as an observable reflected spot on the load, when the forks are not at the level of the forks receiving volume of a pallet. However, when the forks are moved opposite to and in the same plane of the forks receiving volume of the pallet, the previously observable reflective spot essentially disappears, as the laser light beam enters the forks receiving volume. The operator of the forklift is then able to approach the selected pallet load and complete the handling without causing any damage to the load by the unwanted contact of one or two forks hitting the load.

The laser lighting assembly is arranged in selective embodiments. In a preferred embodiment: the on/off switch is positioned in the operator's control locale of a forklift; the fork lift's battery energy is utilized and converted to power the laser light assembly; and the circuitry has its effective length, being changeable as the forks are moved upwardly or downwardly, by utilizing a mechanical take up or let out spool which receives and dispenses coils of the wire of the circuitry.

In another embodiment, the laser lighting assembly is furnished as a self contained accessory type assembly with its housing supporting the laser light creating units, a finger operated switch, and a battery, and having a fastening means to secure the housing directly to a fork of a forklift.

In another embodiment, the laser lighting assembly is furnished as an accessory type assembly with its housing supporting laser light creating units, a battery, and a radio signal receiver controlled switch, and having a fastening means to secure the housing directly to a fork of a forklift, and also having a radio signal transmitter kept in a convenient locale to be handled and manipulated by an operator of a forklift.

These embodiments and other of like purpose are modified and installed in receiving openings provided in the forks and other portions of forklifts, and thereby be installed in forklifts at the time of their manufacture.

DRAWINGS

The laser lighting assembly mounted on a forklift to project a light beam parallel to and in the same plane as a fork in selected embodiments is illustrated in the drawings, wherein:

FIG. 1 is a perspective view of a forklift approaching a column arrangement of loads arranged on respective pallets, and the reflecting spot of the light beam is observed on the load indicating the wrong level of the fork;

FIG. 2 is a perspective view, like FIG. 1, of a forklift approaching a column arrangement of loads arranged on respective pallets, and the reflecting spot of the light beam is not observable, indicating the correct level of the fork matching the level of the fork receiving volume of a pallet to be moved, whereby, the forks of a forklift will reach the lifting position without the forks hitting and damaging a load supported on a pallet.

FIG. 3 is a schematic side view, with some portions removed, of a forklift approaching a column arrangement of loads arranged on respective pallets, and the phantom lines indicate the location to where the forks must be raised, so the light beam will be directed into the fork receiving volume of a pallet, and then the light beam will no longer be observed reflecting from the side of a load, and subsequently when the forklift is moved forwardly, the forks will arrive at their lifting location, without unwantedly hitting any portion of a load, and also shown is an embodiment of laser lighting assembly where the circuitry passes over a take up and play out reel or spool enroute to the controls locale of the forklift, providing on and off laser lighting controls at this convenient operator's position;

Figure 8:
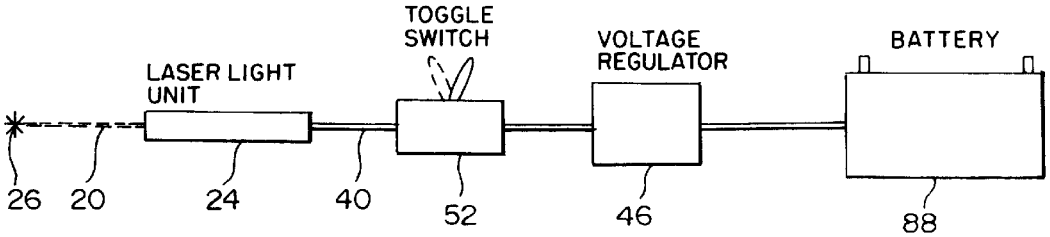
Figure 9:
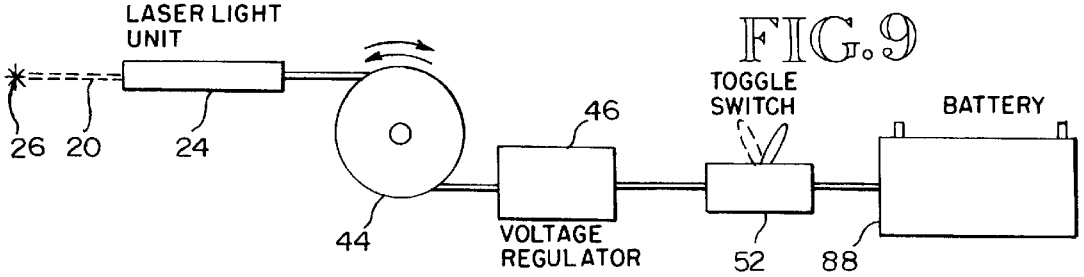

FIG. 8 is a schematic view of circuitry and electrical components of another embodiment thereof pertaining to providing the light beam of laser light, including: circuitry, laser light unit, switch, voltage regulator to lower the direct current voltage from twelve to three volts, and forklift battery providing twelve volts of direct current energy; and FIG. 9 is a schematic view of circuitry and electrical components of another embodiment thereof pertaining to providing the light beam of laser light, including: circuitry, laser light unit, powered take up and let out reel for wires of the circuitry, voltage regulator to lower the direct current voltage from twelve to three volts, switch, and forklift battery providing twelve volts of direct current energy.

DESCRIPTION

How a Laser Lighting Assembly is Utilized

Selected embodiments of a laser lighting assembly mounted on a forklift to project a light beam parallel to and in the same plane as a fork, and utilized to accurately direct the forks into a fork receiving volume of a pallet, thereby avoiding any fork damage to a load on a pallet, are illustrated in the drawings.

To assist all operators of forklifts or vehicles of like purpose, which have forks, or like load supporting members, that are raised and lowered to handle loads, this laser lighting assembly, or lighting assembly of like purpose, is installed to project a light beam forwardly and parallel to and in the same plane as a fork or pair of forks, or a like purpose support.

Figure 1:
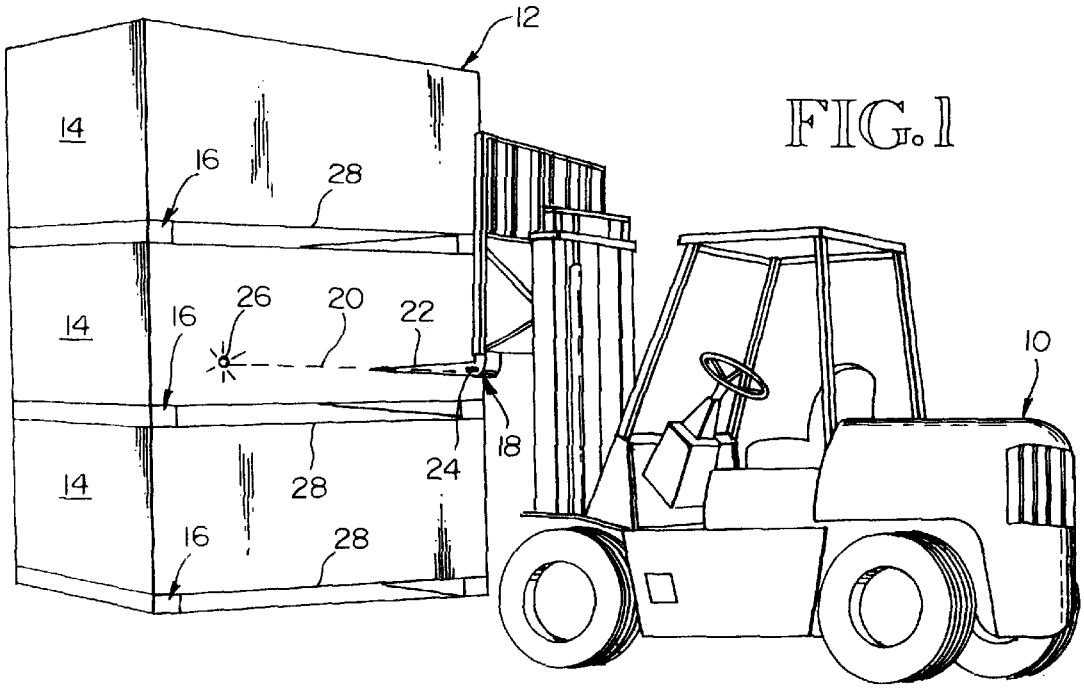

A forklift 10 when approaching a column arrangement 12 for loads 14 positioned on respective pallets 16, or like purpose load receiving units 16, as illustrated in FIG. 1, when equipped with a laser lighting assembly 18, has a light beam 20 projecting forwardly and parallel to a fork 22 and in the same plane as the fork 22. The light beam 20 created by a laser light unit 24 or a unit 24 of similar purpose, is collimated to create a reflected small precise target area 26, referred to as reflection from a spot 26, or reflective spot 26.

Figure 2:
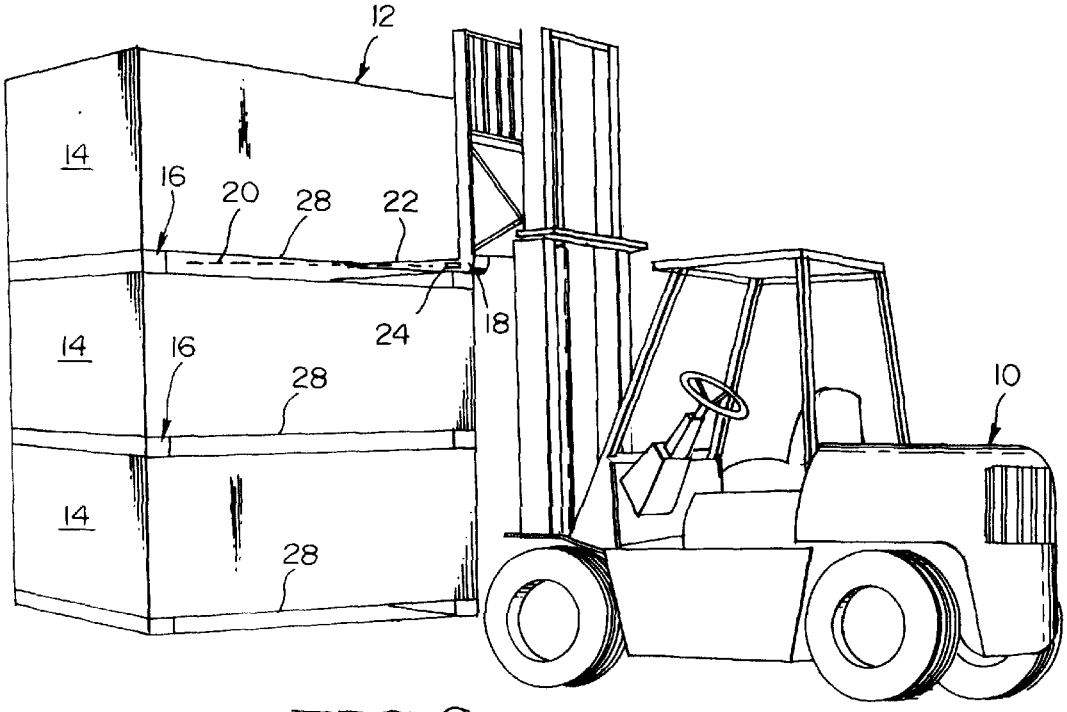

When this reflective spot 26 appears on the load, as shown in FIG. 1, the operator understands he or she has not as yet moved a fork 22, or a pair of forks 22, to an elevation where there is a fork receiving volume 28. When, however, the operator has elevated the forks 22 so the reflective spot 26, in effect, disappears, as illustrated in FIG. 2, he or she then knows the forks 22 are positioned at the same level as the fork receiving volume 28 of a pallet 16.

Thereafter, the operator moves the forklift 10 forward so the forks 22 enter the fork receiving volume 28. Then lifting and moving of the pallet 16 with the load 14 is undertaken successfully. There has been no unintended contact made of any portion of a fork 22 with any portion of a load 14. Any damage to a load 14, created by an impact resulting from a fork 22 being positioned at the wrong elevation, when a forklift 10 is moved toward a load 14, is avoided.

A Laser Lighting Assembly Incorporating Electrical Components of a Forklift

Figure 3A:
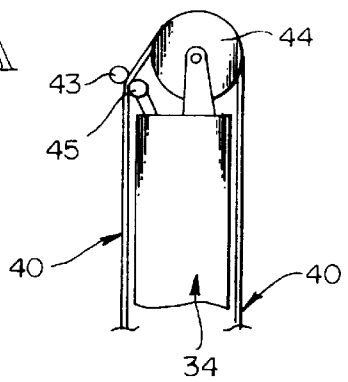
FIG. 3A is a partial enlarged view of the take up and play out reel or spool shown in FIG. 3, to illustrate how two pulleys are positioned to guide the electrical circuit wire to or from the take up and play out reel.
Figure 3:
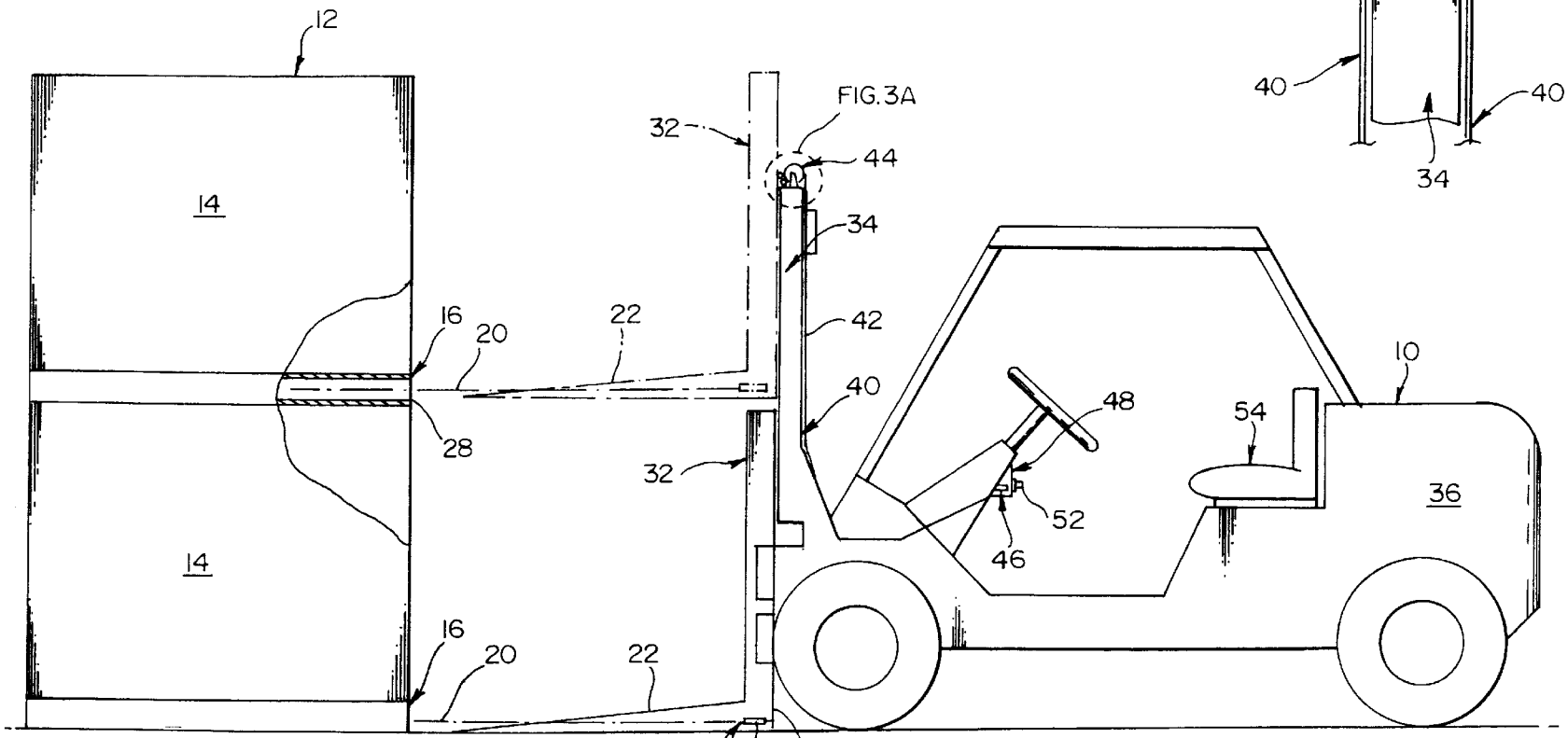

An embodiment 30 of the laser lighting assembly 18 which incorporates some of the electrical components of a forklift 10 is illustrated in FIG. 3. The laser light unit 24, or laser module 24, of the laser lighting assembly 18, as in all embodiments, is secured to a fork 22, where the fork 22 in turn is secured to or made integrally with the vertical load contacting members 32, which are guided, raised, or lowered, by and on the vertical track structure 34 of the forklift 10, and powered by the mechanisms 36 of the forklift 10. The vertical load contacting members 32 are the movable members of the overall backstop structural assembly 38, and the vertical track structure 34 is the non-movable member of the overall backstop structural assembly 38.

Circuitry 40, having three volts of direr current and gauge wires 42, extends from the laser light unit 24 up the vertical load contacting members 32, then over a mechanical wire take up spool 44 mounted at the top of the vertical track structure 34, and continued to a voltage regulator 46 mounted in the instrument locale 48 of the forklift 10. The voltage regulator 46 is connected to circuitry, not shown, of the forklift 10 having twelve volts of direct current supplied by a battery, not shown, of the forklift 10. Lead in or guide out pulleys 43, 45 are used to guide the wire 42 of the circuitry 40 with respect to the spool 44.

An on and off toggle switch 52 is positioned in the instrument locale 10 and in the twelve volt direct current circuitry of the forklift 10, so the operator of the forklift 10, when seated on seat 54 may conveniently turn on or off the laser lighting assembly 18. In conjunction with the toggle switch 52, or in lieu thereof, an automatic motion sensing switch, not shown, and its circuitry, not shown, is utilized so only the battery energy of the forklift 10 will be withdrawn when the forklift 10 is being operated to lift and carry a load 14.

By utilizing this embodiment 30 of the laser lighting assembly 18, the operator of a forklift 10, very conveniently, when necessary, has the laser lighting assembly turned on, to assist him or her in the proper elevation placement of the forks 22 of a forklift, for entry into the fork receiving volume 28 of a pallet 16, and thereby avoiding any damage to a load 14 by an unwanted impact of a fork 22.

Figure 4:
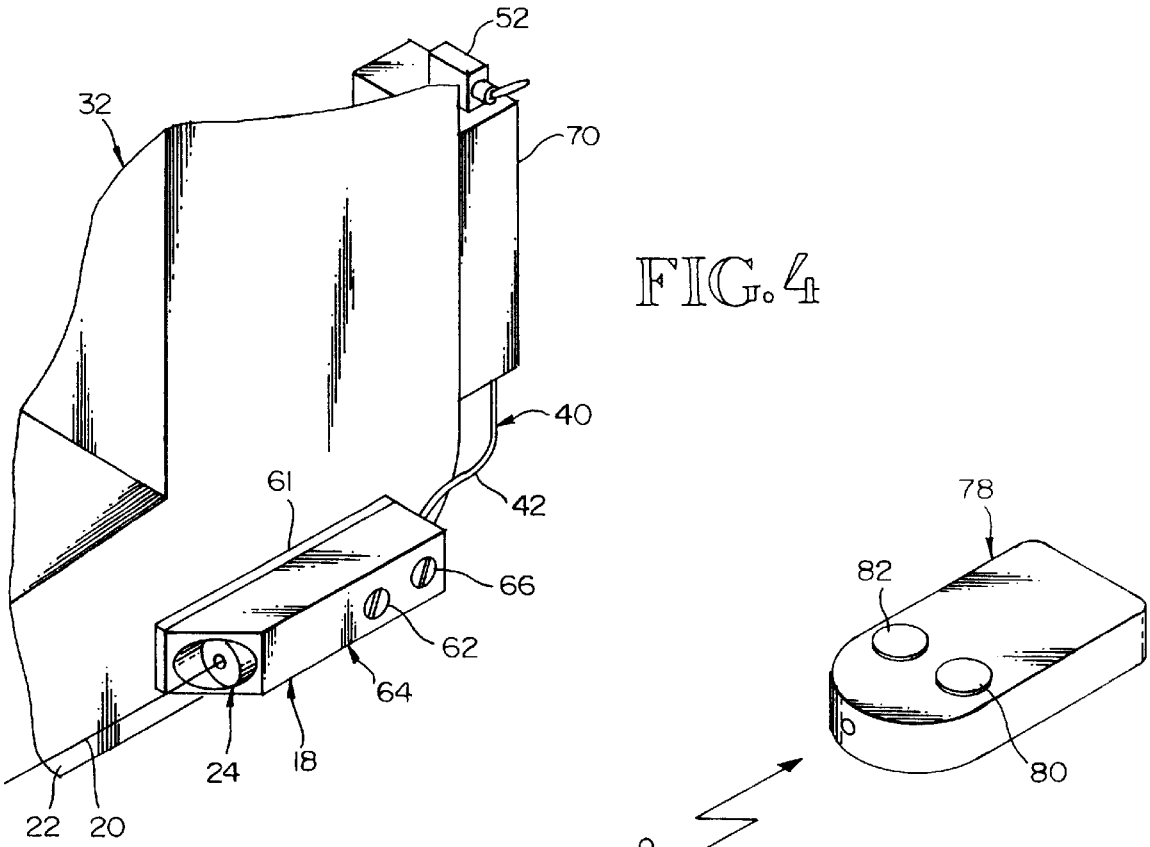
FIG. 4 is a partial perspective view of a side of a fork at the rear thereof illustrating the installation of a self contained embodiment of the laser light producing unit within the housing secured in place with fasteners, circuitry, battery, and switch.

A Laser Lighting Assembly as Self Contained and Not Incorporating Electrical Components of a Forklift The laser lighting assembly 18 is installed as a self contained embodiment 60, as illustrated in FIG. 4, which does not incorporate electrical components of a forklift 10.

Preferably when this assembly or other assemblies are to be installed on a forklift, a quarter inch thick steel plate or bar 61 having at least the height and width dimensions of a casing or housing 64 of a laser light unit 24, is secured to the side of a fork 22 by using a strong adhesive, or by welding. Threaded holes, not shown, are made in the steel plate or bar 61 either before or after its securement to the fork 22. The laser light unit 24 is fitted into a recess 62 of a housing 64. Fasteners 66, passing through holes 68 in the housing 64, are threaded into holes, not shown, which are made in the steel plate or bar 61, to secure the housing 64 in place, so the light beam 20 will be projecting forwardly parallel to the fork 22, and in the same plane as the fork 22, or pair of forks 22. Wires 42 of circuitry 40 extend a short distance to a direct current battery 70 having a voltage comparable to the voltage specified for the operation of the laser light unit 24. Preferably, the battery 70 is mounted at the back of the vertical load contacting member 32 in the plane of the fork 22, where the battery 70 will not sustain any impact damage. During the up and down movements of the forks 22, there must be sufficient clearance for the battery 70. If not, the batter 70 must be secured in another place.

An on and off switch 72 is secured to the battery 70 or nearby to the forklift 10, and is included in the circuitry 40. An operator at the conclusion of his or her operations of the forklift 10, when the laser lighting assembly 18, in this embodiment 60 has been relied upon, upon leaving his or her seat 54, uses this switch 72 to secure the laser lighting assembly 18 until it is needed again.

When the laser lighting assembly 18, in this embodiment 60, has been installed and used to locate the selected fork receiving volume 28 of a pallet 16 in preparing to lift a load 14 on the respective pallet 16, the operator of the forklift 10 avoids causing any damage to any portion of a load 14 by an impact of a misdirected fork 22 or forks 22 located at the wrong elevation, when the forklift 10 is moved forward to pick up the load 14.

Figure 5:
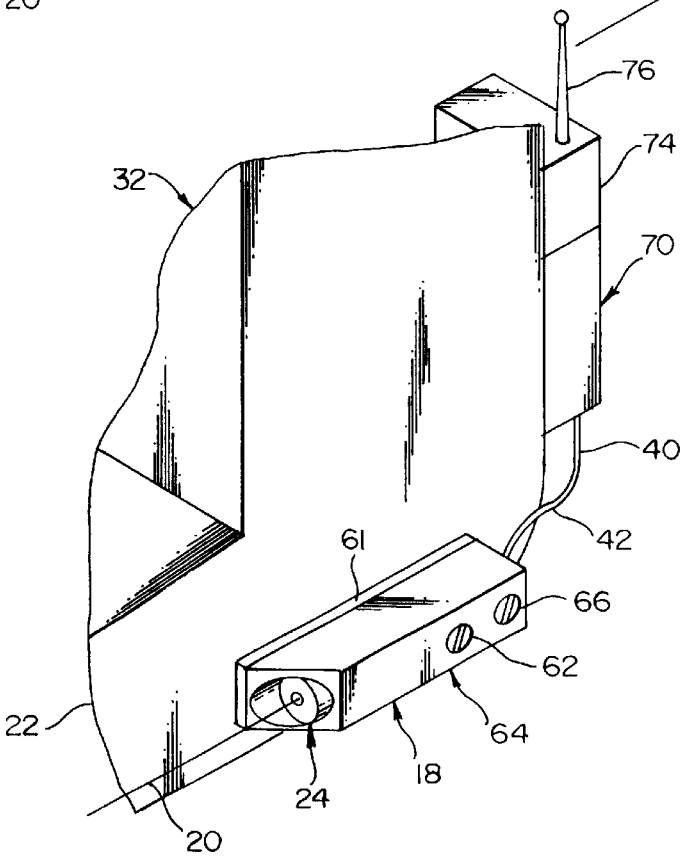
FIG. 5 is a partial perspective view of a side of a fork at the rear thereof, similar to the view of FIG. 4, showing an embodiment of the laser lighting assembly, which includes a movable location transmitter, and a receiver with an aerial, positioned with the battery in the fork locale, where the laser light producing unit and the housing thereof are fastened to the side of the fork.

A Laser Lighting Assembly, Using a Remotely Operated Switch, on an Otherwise Essentially Self Contained Assembly Which Does Not Incorporate Electrical Components of a Forklift The laser lighting assembly 18 is installed almost as a self contained embodiment 72, as illustrated in FIG. 5, which does not incorporate electrical components of a forklift 10. As shown in FIG. 4 and previously described, the laser light unit 24 is fitted into a recess 62 of a housing 64. Fasteners 66, passing through holes 68 in the housing 64 are threaded into holes, not shown, which are made on a fork 22, to secure the housing 64 in place, so the light beans 20 will be projecting forwardly parallel to the fork 22, and in the same plane as the fork 22, or pair of forks 22. Wires 42 of circuitry 40 extend a short distance to a direct current battery 70, preferably mounted at the back of the vertical load contacting member 32.

Secured to the top of the battery 70 is a combined radio frequency receiver and switch unit 74, having an aerial 76. Then a radio frequency transmitter assembly 78 for remote hand handling is provided, having a self contained battery, not shown, and circuitry, not shown, operated by using the on and off finger controls 80, 82.

By utilizing this embodiment 72 of the laser lighting assembly 18, an existing forklift 10, is fitted so the benefits of a directed light beam 20 are realized by an operator, who remains in her or his seat 54 of a forklift 10 to turn on or turn off the laser lighting assembly 18 provided in this embodiment 72. With this convenience of utilization, whenever a load 14 must not be damaged by an impact of a fork 22, the operator turns on the laser light unit 24 and observes the light beam 20 and the reflection thereof to locate the fork receiving volume 28 of a pallet 16, as the reflective spot 26 disappears, when the fork 22, or pair of forks 22, are located at the correct elevation. Upon the forward movement of the forklift 10, the forks 22 enter the fork receiving volume 28, and do not touch the load 14.

Figure 6:
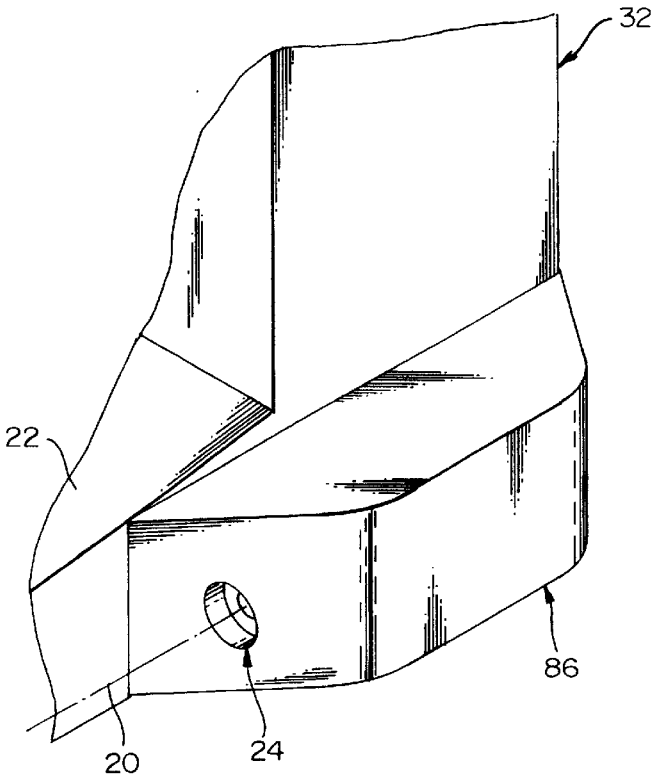
FIG. 6 is a top view of a fork especially manufactured to provide an internal receiving volume in which the laser light producing unit is protectively positioned and secured, with dotted lines indicating internal positioning of the laser light producing unit, and also with dotted lines indicating the projection beam of laser light.

At Time of Manufacture of a Forklift, the Incorporation of Receiving Volume Structures for the Installation of Components of the Laser Lighting Assembly When a forklift, or like purpose vehicle, having forks, or like purpose load supports, is manufactured, some or all components of the laser lighting assembly, or an assembly of like purpose, to direct the light beam parallel to and in the same plane as a fork or forks, are incorporated into the forklift when it is manufactured. By way of example, in FIG. 6, such incorporation of some of the laser lighting assembly is illustrated. In FIG. 6, a fork 22 is shown which has an internal receiving volume 86 in which the laser light producing unit 24 is protectively positioned and secured. The dotted lines indicate the projected light beam 20.

The Objective is the Same When Operating a Forklift, or Like Purpose Vehicle, Equipped With any Embodiment of This Laser Lighting Assembly, the Operator is Always Able to Avoid Damaging Any Portion of a Load by an Unwanted Impact of a Fork, or Like Purpose Pallet Load Supporting Member In respect to the illustrated embodiments, and those not illustrated, the light beam is projected forwardly parallel to a fork and in the plane of a fork, or forks. As the forks are adjusted up or down on the forklift, as the operator is utilizing the controls, he or she is observing the laser dot 26, i.e. the reflective spot 26, which appears past the tip of a fork on the load to be picked up, such as boxes, crates, units of lumber, plywood, etc. When reflective spot 26 disappears in the fork receiving volume 28 of a pallet 16, then the operator, i.e. the driver, is assured that the forks are in the correct position, i.e. at the right elevation, to be inserted, so the load supported on the pallet will thereafter be lifted and moved, and no portion of the load on the pallet will be unwantedly contacted by a portion of a fork.

Figure 7:
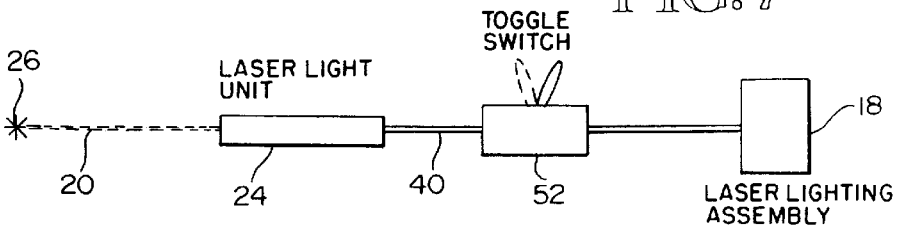
FIG. 7 is a schematic view of circuitry and electrical components of one embodiment thereof pertaining to providing the light beam of laser light, including: circuitry, laser light unit, switch, and battery providing three volts of direct current energy.

Selected Embodiments of Circuitry and Electrical Components Used in Providing the Light Beam of Laser Light Selected embodiments of circuitry and electrical components are illustrated in FIGS. 7, 8, and 9, which are respectively selected to be utilized in various overall embodiments of the laser lighting assembly 18. The self contained embodiment, shown in FIG. 7 to create the observed laser reflective spot 26, via the projection of the laser light beam 20, includes: the laser light unit 24, circuitry 40, switch 52, and battery 70 having three volt direct current energy.

An embodiment utilizing the forklift battery 88, and a voltage regulator 46, to reduce the twelve volt direct current energy to three volt direct current needed for the laser light unit 24, is illustrated in FIG. 8. An embodiment shown in FIG. 9 is similar to the embodiment shown in FIG. 8 and includes a powered take up and let out reel, i.e. spool 44, for circuitry 40.

What is claimed is:

1. A directable high intensity collimated beam of light assembly, mountable on lifting and carrying equipment, on a projecting support thereof, so a collimated beam of light projected forwardly from the light assembly will always be parallel to and in the same plane of the projecting support, and spot like reflections of the collimated light beam will always be essentially observable by the operator of the lifting and carrying equipment, so he or she will avoid damaging any portion of load being supported and moved on a pallet, by the unwanted contact of the load by a portion of a projecting support, comprising:

a. a housing to receive the directable high intensity collimated beam of light components and having a fastening means to secure the housing to a projecting support;

b. a collimated beam of light assembly secured by the housing having: a collimated light creating means; an electrical energy source; circuitry; and a switching means; with the beam of light projecting axis being arranged parallel to the axis of the projecting support.

2. A directable high intensity collimated beam of light assembly mounted on lifting and carrying equipment, as claimed in claim 1:

wherein the housing has fastener receiving holes and the fastening means are screws which are positioned in these fastener receiving holes to extend beyond for entry into threaded holes to be provided in a plate secured to projecting support, and wherein the collimated beam of light creating subassembly, secured by the housing, is in its entirely positioned on the projecting support.

3. A directable high intensity collimated beam of light assembly, mounted on lifting and carrying equipment, as claimed in claimed in claim 1:

wherein the housing has fastener receiving holes and the fastening means are screws which are positioned in these fastener receiving holes to extend beyond for entry into threaded holes to be provided in a plate secured to a projecting support; and wherein the collimated beam of light creating subassembly, secured by the housing, has a transmitter and receiver switching means, with the transmitter to be positioned nearby an operator of the lifting and carrying equipment, and the receiver and all other components of the collimated beam of light creating subassembly, being positioned on the projecting support.

4. A directable high intensity collimated beam of light assembly mounted on a lifting and carrying equipment, as claimed in claim 1:

wherein the housing has fastener receiving holes and the fastening means are screws which are positioned in these fastener receiving holes to extend beyond the entry into threaded holes to be provided in a plate secured to a projecting support;

wherein the collimated beam of light creating subassembly, secured by the housing, has circuitry extending from the collimated beam of light creating subassembly, to control locale of lifting and carrying equipment, where a switching means is installed for the concerning manipulation by an operator of the lifting and carrying equipment; and wherein the circuitry includes a spool to be rotably secured to a top portion of a vertical track which guides the up and down motion of the projecting support, whereby the spool is rotated in respective circular directions to either take up or play out circuitry upon the raising or lowering of the projecting support.

5. A directable high intensity collimated beam of light assembly, mounted on lifting and carrying equipment, as claimed in claim 1:

wherein the fastening means for securing the housing to a projecting support is a portion of a projecting support provided with an opening to complementary receive and to hold the directable high intensity collimated beam of light assembly.

6. A directable high intensity collimated beam of light assembly mounted on lifting and carrying equipment, as claimed in claim 1, wherein the electrical energy source is a battery having a supply of three volt direct current electricity.

7. A directable high intensity collimated-beam of light assembly mounted on lifting and carrying equipment, as claimed in claim 1:

wherein the electrical energy source is a battery having a supply of twelve volt direct current electricity, and wherein the collimated beam of light assembly also includes a voltage regulator to reduce the twelve volt direct current electricity to three volt direct current electricity.

8. A directable high intensity collimated beam of light assembly, which is a laser light assembly, mountable on a forklift, on a fork thereof, so a laser beam of light projected forwardly from the light assembly is always parallel to and in the same plane of the fork, and spot like reflections of the laser light beam are always observable by the operator of the forklift, so he or she avoids damaging any portion of a load being moved and stored on a pallet, by the unwanted contact of the load by a portion of a fork, comprising:

a. a housing to receive a directable high intensity collimated beam of light components, which are laser light components, and the housing has means to secure the housing to a fork; and b. a directable high intensity collimated beam of light components, which are laser light components, secured within the housing, and the components thereof also include an electrical energy source, circuitry, and a switching means.

9. A directable high intensity collimated beam of light assembly, as claimed in claim 8, wherein the directable high intensity collimated beam of light components are positioned within the housing, so when the housing is secured to the fork the beam of light projecting axis is parallel to the axis of the housing and the axis of the forks.

10. A directable high intensity collimated beam of light assembly, as claimed in claim 9, wherein the means of the housing, to secure the housing to the fork, is arranged to secure directable high intensity collimated beam of light assembly to an outside edge of a fork at the corner of the fork, where the horizontal and vertical portions of the fork meet together.

11. A laser light assembly, mountable on a forklift, on the fork thereof, so a laser beam of light projected forwardly from laser light assembly is always parallel to and in the same plane of the fork, and spot like reflections of the laser light beam are always observable by the operator of the forklift, so he or she avoids damaging any portion of a load being moved and stored on a pallet by the unwanted contact of the load by a portion of a fork, comprising:

a. a housing to receive the laser light components and the housing has a portion to be secured the fork; and b. the laser light components which also include an electrical energy source, circuitry, and a switching means, are all secured within and by the housing.

12. A laser light assembly mountable on a forklift, as claimed in claim 11, wherein the laser light components are positioned within the housing, so when the housing is secured to the fork, the projecting beam of laser light has the axis thereof arranged parallel to the axis of the housing and to the horizontal axis of the fork.

13. A laser light assembly mountable on a forklift, as claimed in claim 12, wherein the portion of the housing to be secured, is arranged for securement to an outside edge of a fork, at the corner of the fork, where the horizontal and vertical portions of the fork meet together.

14. A laser light assembly mountable on a forklift, as claimed in claim 13 wherein the portion of the housing to be secured to the fork is sized and contoured to be welded to the fork.

15. A laser light assembly mountable on a forklift, as claimed in claim 13, wherein the portion of the housing to be secured to the fork is sized, formed, and contoured, to be secured to the fork by fasteners.

* * * * *